US007380926B2

(12) United States Patent
Studer et al.

(10) Patent No.: US 7,380,926 B2
(45) Date of Patent: Jun. 3, 2008

(54) METHODS AND APPARATUSES FOR USE IN INKJET PENS

(76) Inventors: Anthony D. Studer, 1000 NE. Circle Blvd., Corvallis, OR (US) 97330; Kevin D. Almen, 1000 NE. Circle Blvd., Corvallis, OR (US) 97330; David M. Hagen, 1000 NE. Circle Blvd., Corvallis, OR (US) 97330

( * ) Notice: Subject to any disclaimer, the term of this patent is extended or adjusted under 35 U.S.C. 154(b) by 368 days.

(21) Appl. No.: 11/111,127

(22) Filed: Apr. 20, 2005

(65) Prior Publication Data

US 2006/0238557 A1 Oct. 26, 2006

(51) Int. Cl.
*B41J 2/175* (2006.01)

(52) U.S. Cl. ..... 347/86

(58) Field of Classification Search ..... 347/85, 347/86, 20, 40, 42, 43, 47
See application file for complete search history.

(56) References Cited

U.S. PATENT DOCUMENTS

2003/0142183 A1 7/2003 Rodriguez Mojica et al.

FOREIGN PATENT DOCUMENTS

| | | |
|---|---|---|
| EP | 0375383 | 6/1990 |
| EP | 00437363 | 7/1991 |
| JP | 08-001931 | 1/1996 |
| JP | 2000-043279 | 2/2000 |

OTHER PUBLICATIONS

International Search Report for Application No. PCT/US2006/012920. Report issued Aug. 8, 2006.

*Primary Examiner*—Shih-Wen Hsieh

(57) ABSTRACT

Methods and apparatuses are provided for use inkjet pens. One method includes, during an initial stage of pen life, drawing ink from an ink reservoir through a standpipe, and, during an extended stage of pen life, allowing external air to enter into the standpipe through a standpipe bubbler and drawing ink from within the standpipe but not the ink reservoir.

14 Claims, 7 Drawing Sheets

METHODS AND APPARATUSES FOR USE IN INKJET PENS

BACKGROUND

Some printing devices use inkjet pens to print images onto print media. These inkjet pens need to be replaced when out of ink. Unfortunately, some inkjet pen designs run out of ink for printing while there is still some ink left inside. This ink is essentially stranded as a result of certain design aspects, such as those that ensure that ink does not leak from the inkjet pen's printhead nozzles.

It would be useful to reduce the amount of ink that is stranded inside an inkjet pen.

BRIEF DESCRIPTION OF THE DRAWINGS

The following detailed description refers to the accompanying figures.

DETAILED DESCRIPTION

Figure 1A:
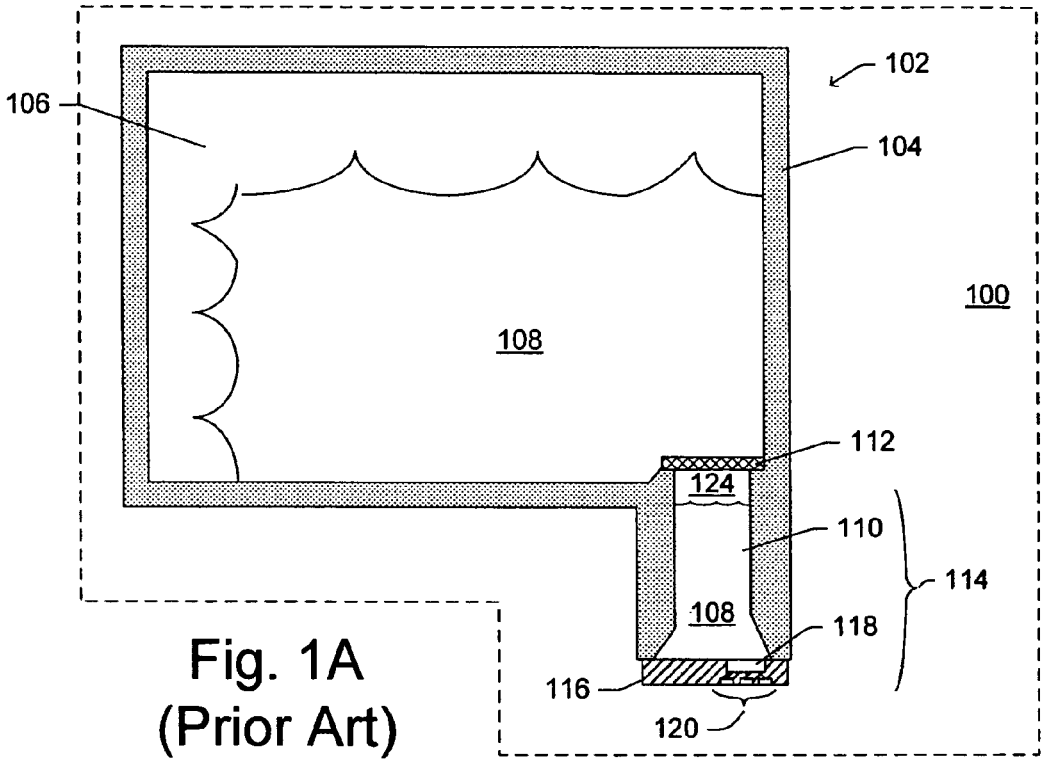
Fig. 1A (Prior Art)
FIG. 1A is an illustrative diagram depicting, in a cross-sectional view, certain features of a conventional inkjet pen at the beginning of its pen life.

FIG. 1A is an illustrative diagram depicting, in a cross-sectional view, certain features of a conventional inkjet pen 102 at the beginning of its pen life. Inkjet pen 102 is operatively coupled to a printing device 100 and is configured to selectively eject ink onto a print media (not shown) to form an image thereon. In this example, inkjet pen 102 includes a body 104 that forms or otherwise supports an ink reservoir 106. Ink reservoir 106 may include a foam or other like capillary mechanism, a biased bag or diaphragm, or the like that is design to hold ink and provide a back pressure that keeps the ink 108 (illustrated as a region within ink reservoir 106) from leaking out through the printhead 114. Ink 108 is provided to printhead 114 though a standpipe 110. In this example, standpipe 110 is separated from inkjet cartridge 106 by a filter 112. Filter 112 is configured to keep unwanted particles out of the printhead. Filter 112 may also help maintain the back pressure in standpipe 110.

Standpipe 110 is configured to supply ink 108 that has passed through filter 112 to the printhead 114. In this example, standpipe 110 supplies ink 108 to a plurality of controllable inkjet nozzles that are formed in an orifice plate 116. Here, ink 108 from standpipe 110 enters into an ink channel 118 that is fluidically coupled to each of the nozzles 120. Standpipe 110 also serves in this conventional inkjet pen as a warehouse for air or other gases (herein, simply referred to as internal air 124) that may be produced during operation of the inkjet pen and/or are otherwise present within standpipe 110.

Figure 1B:
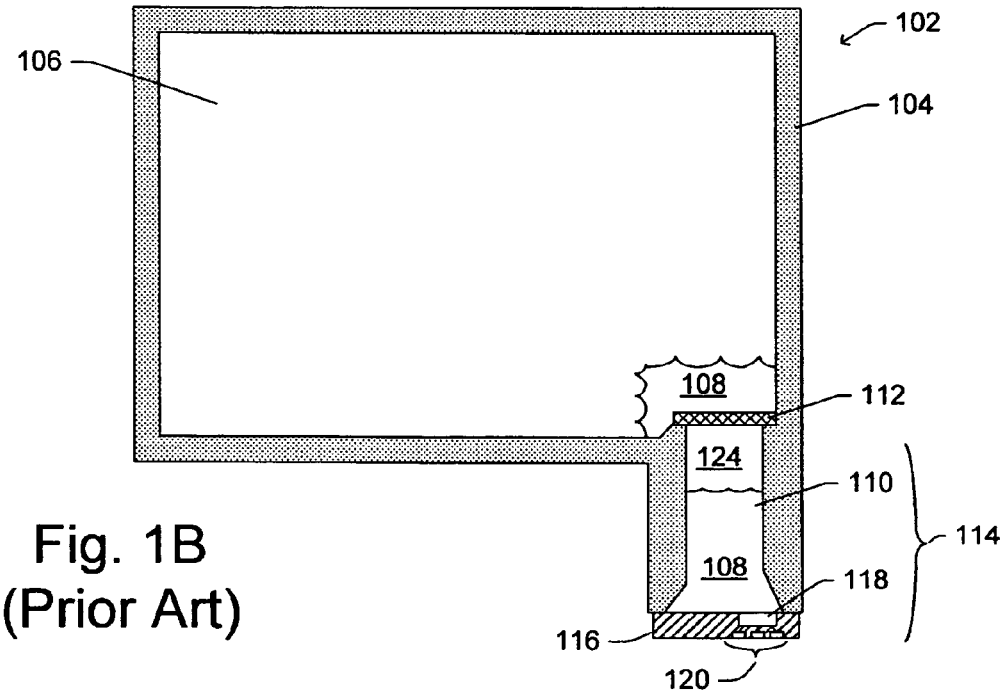
Fig. 1B (Prior Art)
FIG. 1B is an illustrative diagram depicting the conventional inkjet pen of FIG. 1 at the end of its pen life.

FIG. 1B is an illustrative diagram depicting the conventional inkjet pen 102 of FIG. 1 at the end its pen life. As shown, the amount of ink 108 within ink reservoir 106 has been significantly reduced. The back pressure is now so strong that the remaining ink 108 in ink reservoir 106 cannot be drawn into standpipe 110 by the action of printhead 114. Furthermore, the remaining ink 108 in standpipe 110 can not be drawn down further and used by printhead 114 as a result of the back pressure. Consequently, the inkjet pen has reached the end of its life with some ink stranded in its standpipe.

Figure 2A:
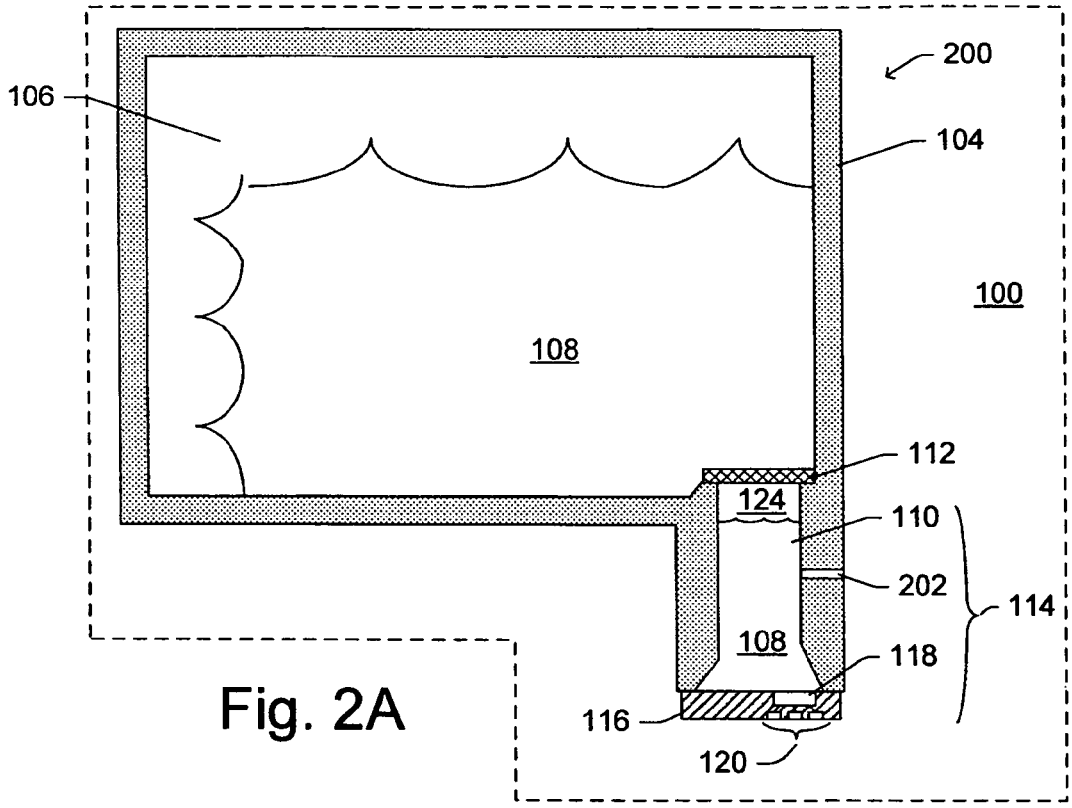
FIG. 2A is an illustrative diagram depicting, in a cross-sectional view, certain features of an exemplary inkjet pen having a standpipe bubbler during an initial stage of pen life, in accordance with certain implementations of the present invention.

FIG. 2A is an illustrative diagram depicting, in a cross-sectional view, certain features of an exemplary inkjet pen 200 having a standpipe bubbler 202 during an initial stage of pen life, in accordance with certain implementations of the present invention.

In this example, inkjet pen 200 is configured to operate for an extended stage of pen life by allowing external air to enter into standpipe 110 via a standpipe bubbler 202 once the back pressure reaches a threshold level. In this manner, substantially all of the ink 108 within standpipe 110 may be used by printhead 114 and very little if any ink remains stranded in standpipe 110 at the end of the extended stage of pen life.

As illustrated in FIG. 2A, standpipe bubbler 202 includes at least one opening that fluidically couples standpipe 110 with external air. Those skilled in the art will recognize that the location, shape and/or size of such an opening may vary depending on the design of the inkjet pen.

While the inkjet pens in this disclosure illustrate a single color pen, it is intended that the various methods and apparatuses are applicable to multiple colored pens having a plurality of standpipes and thus standpipe bubblers.

Figure 2B:
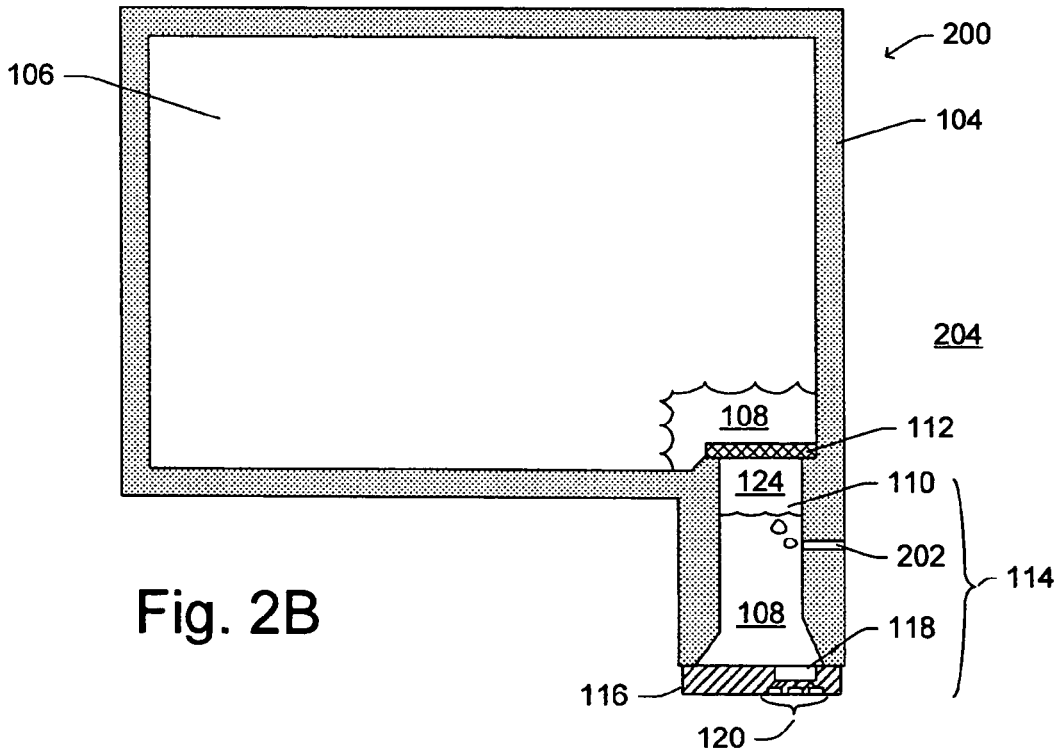
FIG. 2B is an illustrative diagram depicting the exemplary inkjet pen of FIG. 2A during an extended stage of pen life, in accordance with certain implementations of the present invention.

FIG. 2B shows exemplary inkjet pen 200 during an extended stage of pen life. As shown, the amount of ink 108 within ink reservoir 200 has been significantly reduced. The back pressure is now so strong that the remaining ink 108 in ink reservoir 200 cannot be drawn into standpipe 110 by the action of printhead 114. However, the remaining ink 108 in standpipe 110 can be drawn down further and used by printhead 114 because external air 204 is drawn into standpipe 110 through the standpipe bubbler 202 by the action of printhead 114. The external air 204 that "bubbles" or otherwise enters into standpipe 110 mixes with internal air 124. Consequently, inkjet pen 200 is able to extend its life when compared to conventional inkjet pen 102.

Figure 2C:
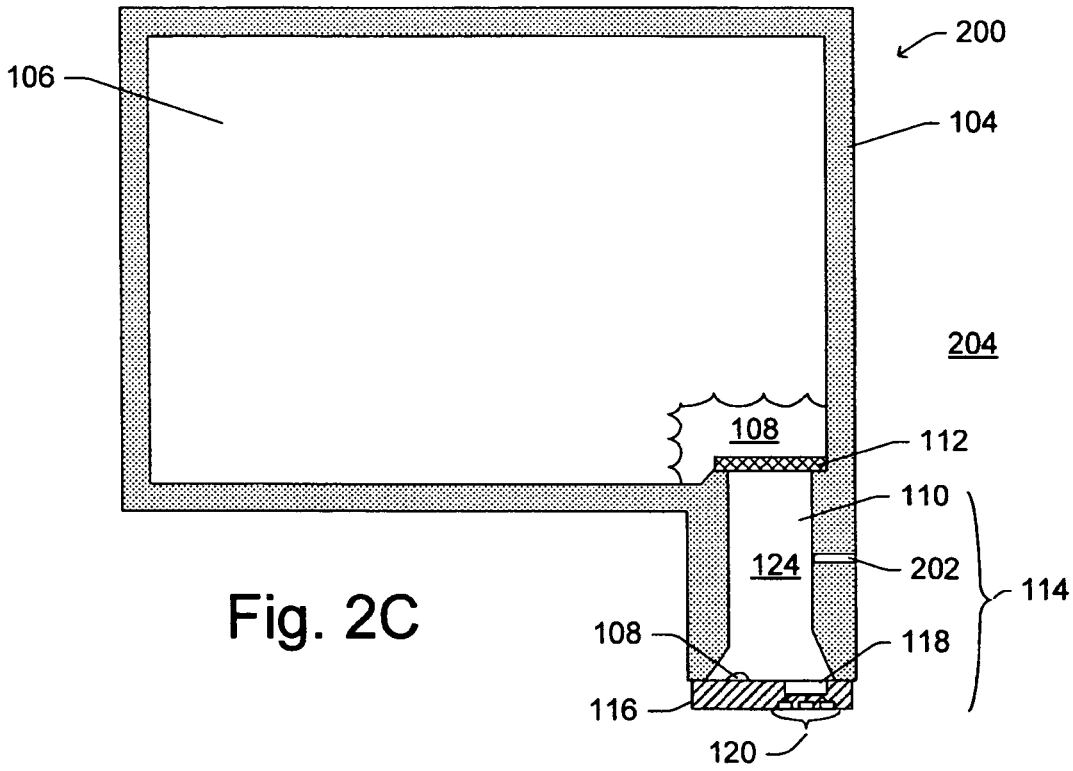
FIG. 2C is an illustrative diagram depicting the exemplary inkjet pen of FIG. 2A at the end of its pen life, in accordance with certain implementations of the present invention.

At the end of the extended stage of pen life, as illustrated in FIG. 2C, very little if any ink 108 remains stranded in standpipe 110. Those skilled in the art will recognize that in certain implementations, a portion of standpipe bubbler 202 may also form or otherwise lead to a labyrinth arrangement (not shown) to reduce the water vapor transfer rate (WVTR) of inkjet pen 200. Additionally, as is known in the art, a label or the like may be used to cover at least a portion of such a labyrinth arrangement.

Figure 3A:
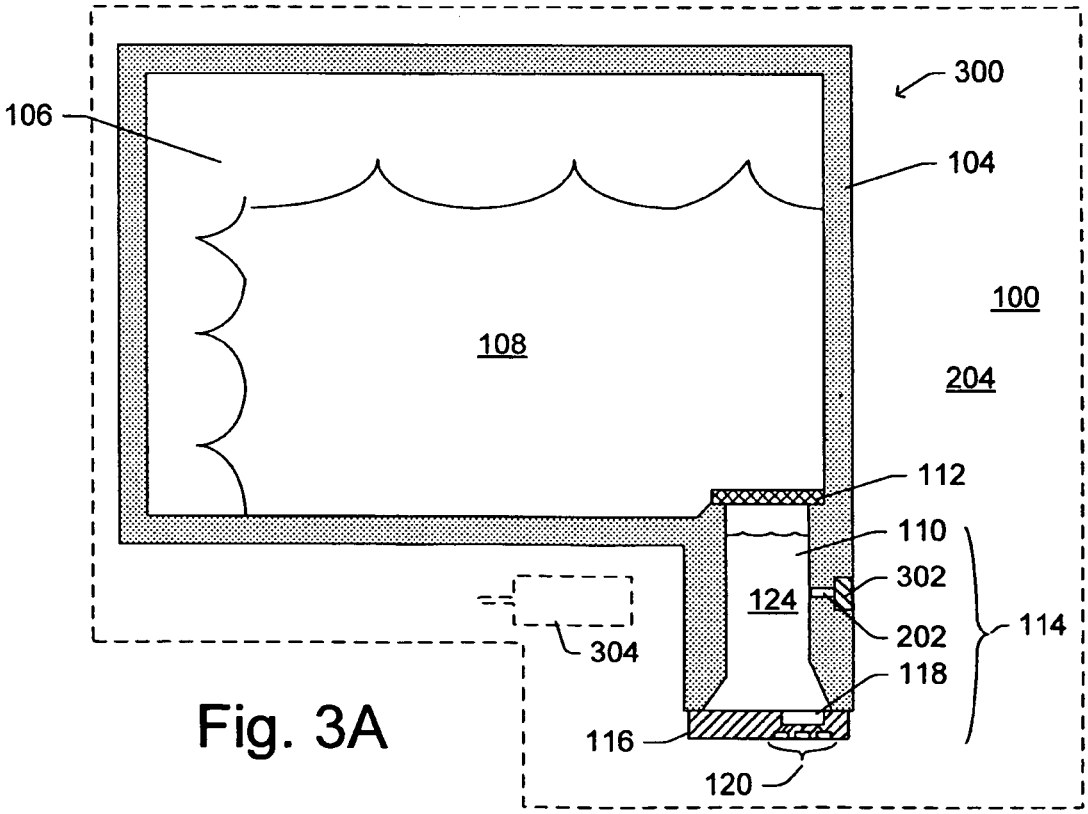
FIG. 3A is an illustrative diagram depicting, in a cross-sectional view, certain features of another exemplary inkjet pen having a standpipe bubbler during an initial stage of pen life, in accordance with certain implementations of the present invention.

FIG. 3A is an illustrative diagram depicting, in a cross-sectional view, certain features of another exemplary inkjet pen 300 having a standpipe bubbler during an initial stage of pen life, in accordance with certain further implementations of the present invention.

In this example, inkjet pen 300 is configured to operate for an extended stage of pen life by allowing external air to enter into standpipe 110 via a standpipe bubbler 202 once a breach mechanism 302 has been breached or otherwise acted upon.

In FIG. 3A, breach mechanism 302 hermetically seals the opening of standpipe bubbler 202, which is fluidically coupled with standpipe 110. This seal prevents external air from entering into standpipe 110.

Figure 3B:
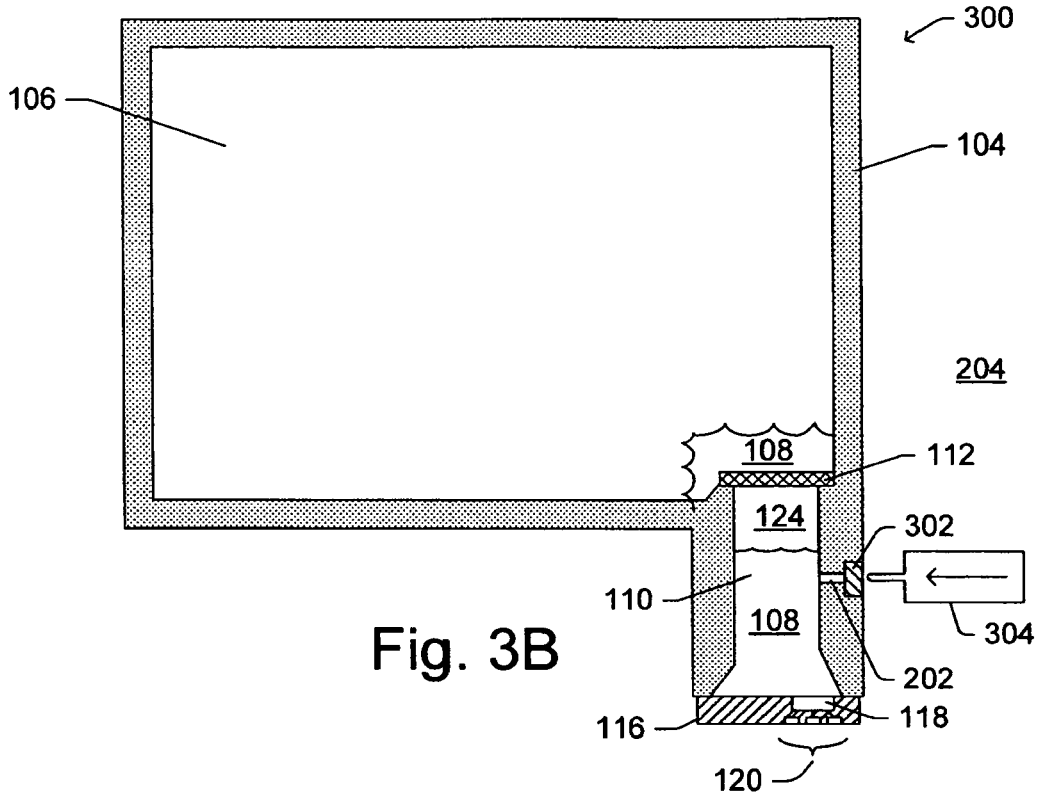
FIGS. 3B-C are illustrative diagrams depicting the exemplary inkjet pen of FIG. 3A at the end of its initial stage of pen life and during an extended stage of pen life, respectively, in accordance with certain implementations of the present invention.

FIG. 3B shows exemplary inkjet pen 300 at end of its initial stage of pen life. As shown, the amount of ink 108 within ink reservoir 300 has been significantly reduced. The back pressure is now so strong that the remaining ink 108 in ink reservoir 300 cannot be drawn into standpipe 110 by the action of printhead 114. Likewise, the remaining ink 108 in standpipe 110 cannot be drawn down further and used by printhead 114.

To allow the ink in standpipe 110 to be drawn down further and used by printhead 114, a breaching device 304 is employed to breach or otherwise act upon breach mechanism 302. In this example, breaching device 304 is configured to permanently puncture breach mechanism 302. Breaching device 304 may be user operated and/or included within and operated by printing device 100.

In certain other implementations, breach mechanism 302 may include a label or section of adhesive tape or the like that is removed or otherwise altered (e.g., punctured) by the user or printing device to unseal the standpipe bubbler. In certain implementations, as those skilled in the art will recognize to further maximize the efficiency of breach mechanism 302 the selected materials may be designed to fail in a controlled manner so as to unseal the standpipe.

In certain implementations, breaching device 304 may just temporarily open breach mechanism 302 to allow external air to enter into standpipe 110.

Figure 3C:
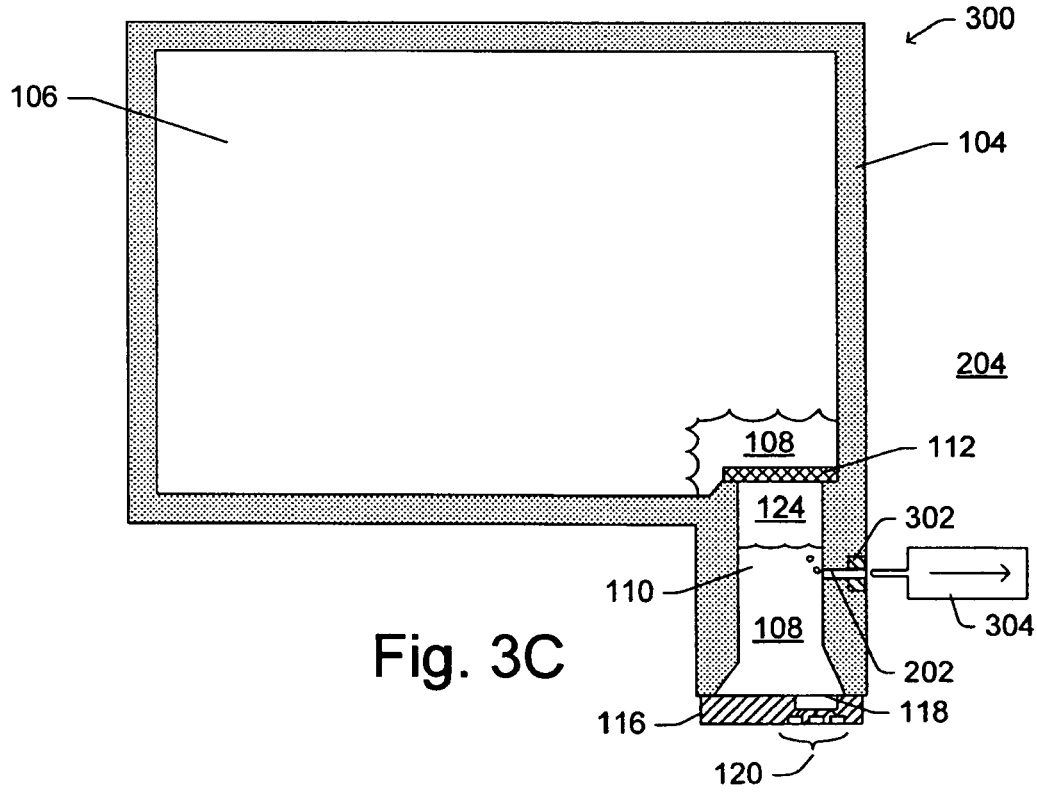

FIG. 3C shows exemplary inkjet pen 300 during an extended stage of pen life as external air 204 is drawn into standpipe 110 by the action of printhead 114. External air 204 is allowed to enter standpipe 110 because breach mechanism 302 has been altered is not acting as a seal. Consequently, inkjet pen 300 is able to extend its life when compared to conventional inkjet pen 102

Figure 3D:
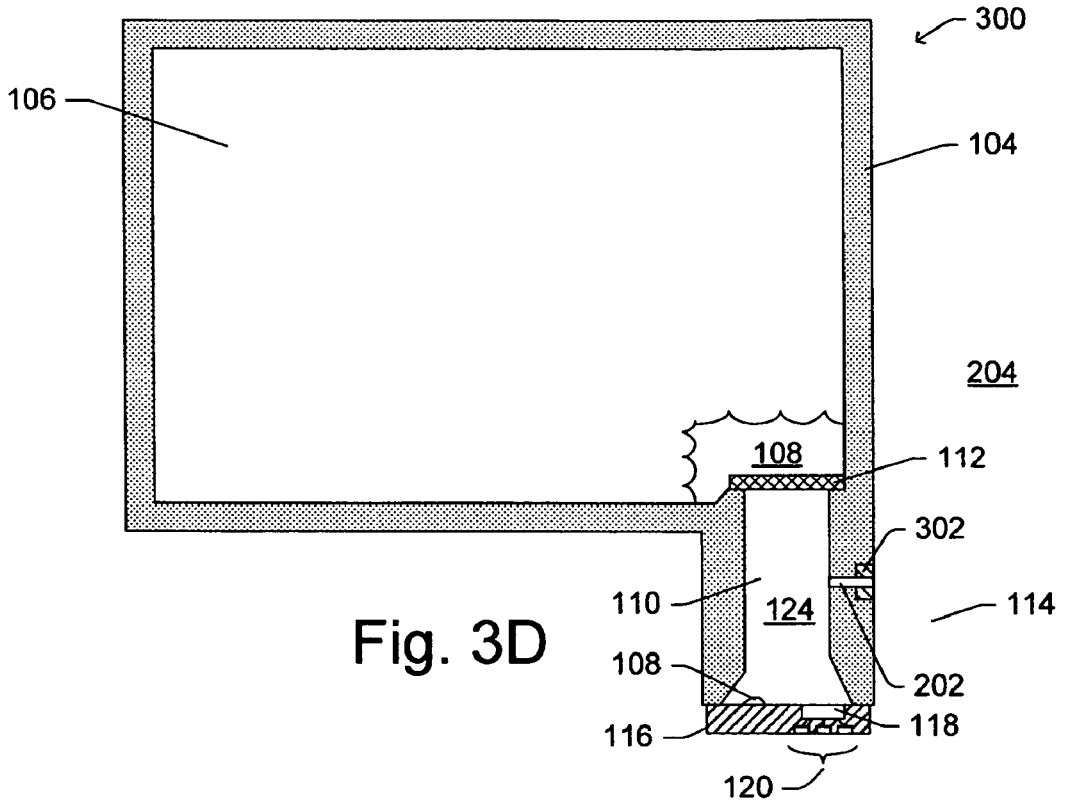
FIG. 3D is an illustrative diagram depicting the exemplary inkjet pen of FIG. 3C at the end of its pen life, in accordance with certain implementations of the present invention.

At the end of the extended stage of pen life, as illustrated in FIG. 3D, very little if any ink 108 remains stranded in standpipe 110.

Figure 4A:
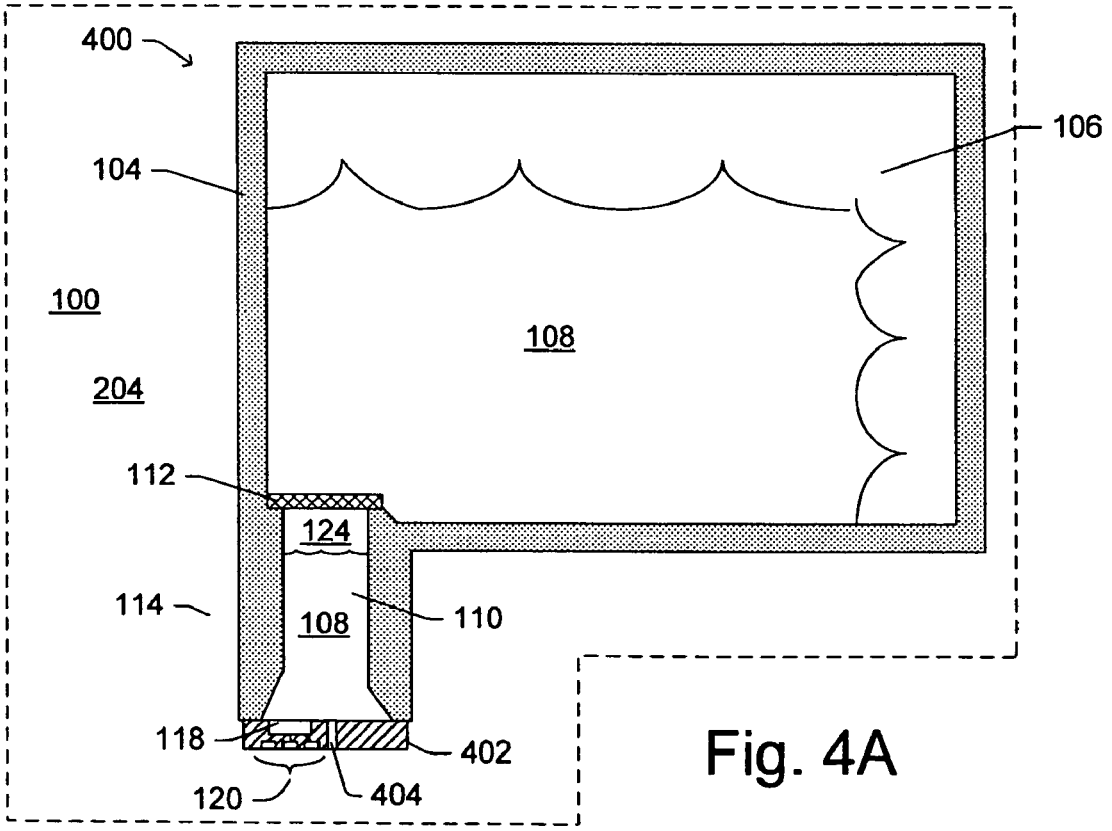
FIG. 4A is an illustrative diagram depicting, in a cross-sectional view, certain features of yet another exemplary inkjet pen having a standpipe bubbler during an initial stage of pen life, in accordance with certain implementations of the present invention.

FIG. 4A is an illustrative diagram depicting, in a cross-sectional view, certain features of yet another exemplary inkjet pen 400 having a standpipe bubbler 404 during an initial stage of pen life, in accordance with certain implementations of the present invention.

As illustrated, inkjet pen 400 includes an orifice plate 402 having a standpipe bubbler 404. In this example, standpipe bubbler 404 includes at least one opening that fluidically couples standpipe 110 to external air 204.

Those skilled in the art will recognize that the location, shape and/or size of such a standpipe opening and/or any other features associated with the various exemplary embodiments of standpipe bubblers will vary depending on the design of the inkjet pen, the ink(s), etc.

Inkjet pen 400 is configured to operate for an extended stage of pen life by allowing external air 204 to enter into standpipe 110 via standpipe bubbler 404 once the back pressure reaches a threshold level. In this manner, substantially all of the ink 108 within standpipe 110 may be used by printhead 114 and very little if any ink remains stranded in standpipe 110 at the end of the extended stage of pen life.

Figure 4B:
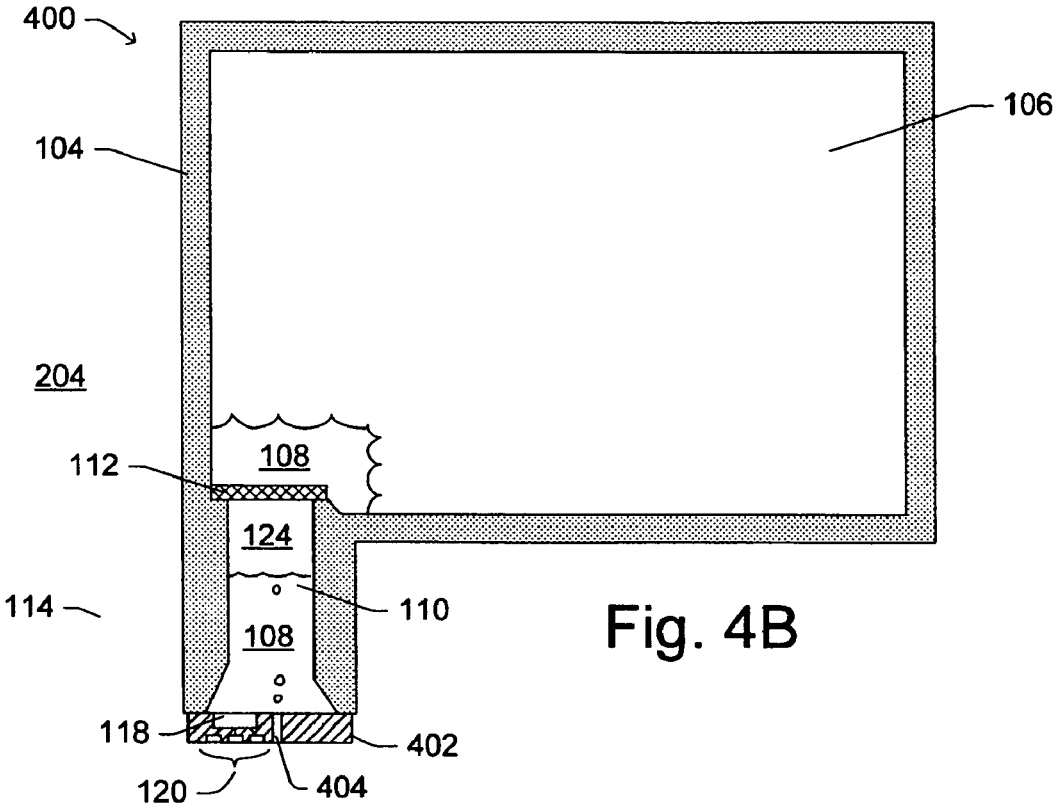
FIG. 4B is an illustrative diagram depicting the exemplary inkjet pen of FIG. 4A during an extended stage of pen life, in accordance with certain implementations of the present invention.

FIG. 4B shows exemplary inkjet pen 400 during an extended stage of pen life. As shown, the amount of ink 108 within ink reservoir 400 has been significantly reduced. The back pressure is now so strong that the remaining ink 108 in ink reservoir 200 cannot be drawn into standpipe 110 by the action of printhead 114. However, the remaining ink 108 in standpipe 110 can be drawn down further and used by printhead 114 because external air 204 is drawn into standpipe 110 through standpipe bubbler 404 by the action of printhead 114. Consequently, inkjet pen 400 is able to extend its life when compared to conventional inkjet pen 102.

Figure 4C:
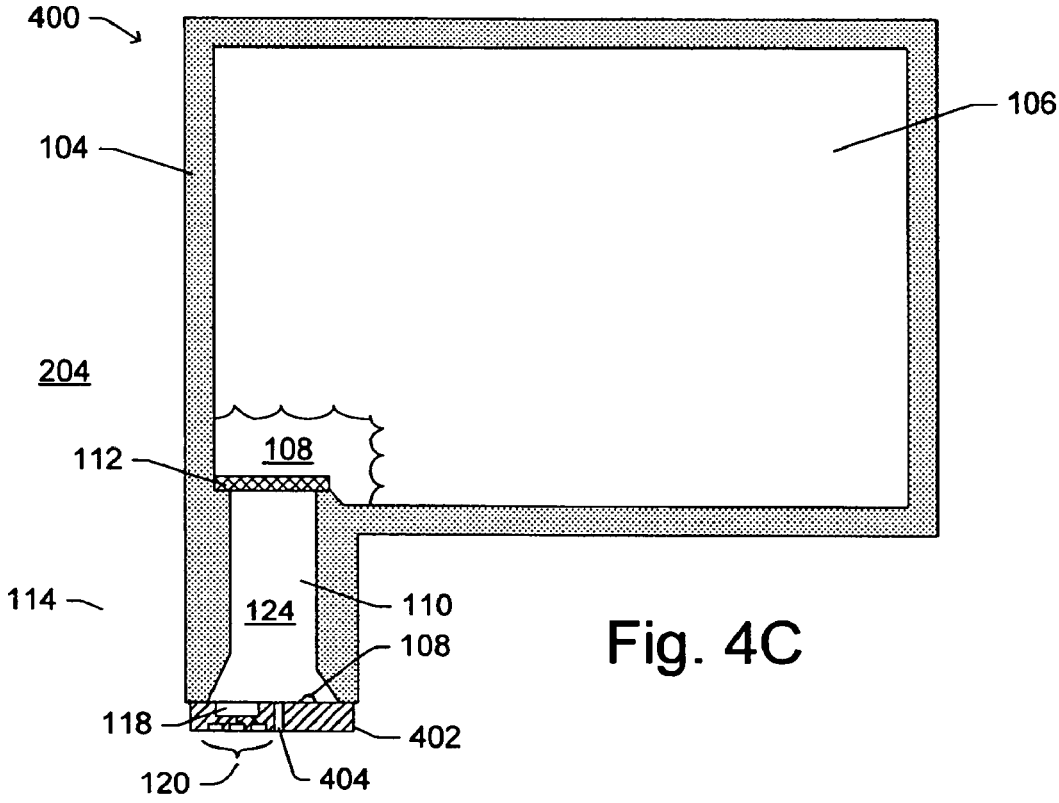
FIG. 4C is an illustrative diagram depicting the exemplary inkjet pen of FIG. 4A at the end of its pen life, in accordance with certain implementations of the present invention.

At the end of the extended stage of pen life, as illustrated in FIG. 4C, very little if any ink 108 remains stranded in standpipe 110.

Figure 5:
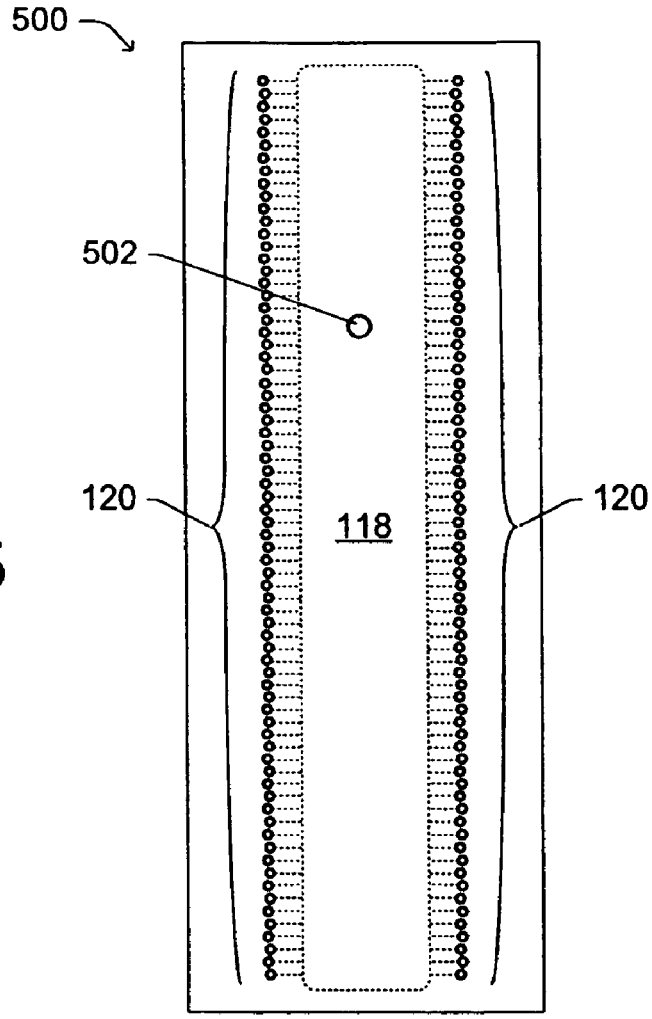
FIG. 5 is an illustrative diagram depicting an exemplary inkjet pen orifice plate having an opening of a standpipe bubbler, in accordance with certain implementations of the present invention.

FIG. 5 is an illustrative diagram depicting an exemplary inkjet pen orifice plate 500 having an opening 502 of a standpipe bubbler, in accordance with certain implementations of the present invention.

As shown, exemplary orifice plate 500 forms a plurality of nozzles 120, arranged in two rows. As illustrated by the dashed lines, within orifice plate 502, each of the nozzles is fluidically coupled to draw ink from ink channel 118. Opening 502 of a standpipe bubbler is also fluidically coupled to ink channel 118.

It is noted that the figures presented herein are not drawn to scale but rather drawn to illustrate certain features and aspects of some exemplary methods and apparatuses.

Those skilled in the art will recognize that the location, shape and/or size of the standpipe bubbler openings will depend on the design of a particular pen.

Figure 6:
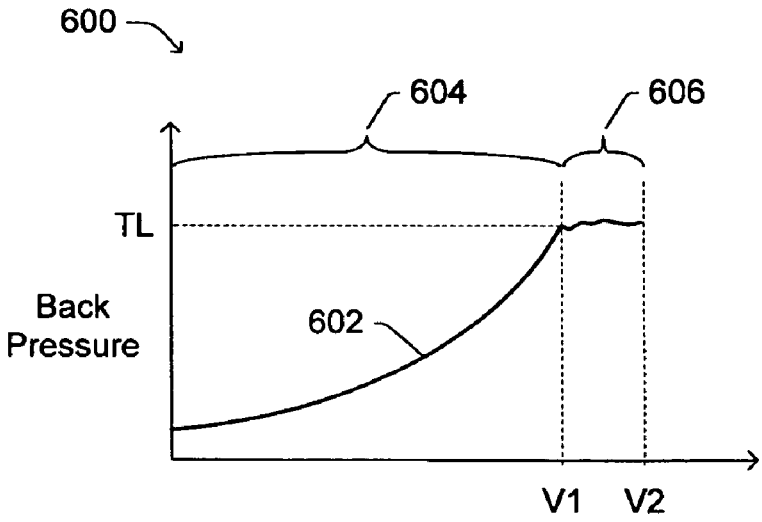
FIG. 6 is a graph depicting the back pressure verses delivered ink volume for an exemplary inkjet pen having a standpipe bubbler, in accordance with certain implementations of the present invention.

FIG. 6 is a graph 600 depicting the back pressure verses delivered ink volume for an exemplary inkjet pen having a standpipe bubbler, in accordance with certain implementations of the present invention.

The x-axis of graph 600 represents the delivered ink volume by the printhead and the y-axis represents the back pressure provided by the ink reservoir. Line 602 illustrates the relationship between these two parameters. As shown, the back pressure tends to increase as the delivered ink volume increases.

Conventional inkjet pen 102 of FIG. 1 would usually deliver up to a delivered ink volume of V1, at which point the pen life essentially ends because the back pressure prevents the delivery of ink leaving ink stranded within standpipe 110. It is recognized that some additional ink may be drawn from the ink reservoir after V1, but this additional volume will typically be substantially too low to support acceptable printing results. To the contrary, the exemplary inkjet pens of FIGS. 2-4 that include a standpipe bubbler will operate through an initial stage of pen life 604 plus an extended stage of pen life 606, thereby resulting in a greater delivered ink volume of V2. As shown, when the back pressure reaches a threshold level TL, the standpipe bubbler(s) in such inkjet pens will start allowing external air 204 to enter into standpipe 110. If the inkjet pen includes a breach mechanism 302 or other like selectively operated opening, then the breach mechanism can be breach or otherwise acted upon at or about the point that the back pressure reaches threshold level TL.

While the exemplary inkjet pens of FIGS. 2-4 operate in extended stage of pen life 606, most if not all of the ink used for print will be drawn from the standpipe. In some implementations, however, some additional ink may be drawn into the standpipe from the ink reservoir while operating in extended stage of pen life 606.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. An inkjet pen comprising:

an ink reservoir;

a printhead having an orifice plate with nozzles therein through which ink may be ejected from the printhead;

a standpipe through which ink may flow from said ink reservoir to said printhead;

a filter between said ink reservoir and said standpipe such that ink entering said standpipe from said ink reservoir passes through said filter; and a standpipe bubbler distinct from said nozzles for selectively introducing external air into said standpipe but not into said ink reservoir except through said filter.

2. The inkjet pen as recited in claim 1, further comprising a body forming at least a portion of said standpipe and wherein said standpipe bubbler comprises an opening extending through said body.

3. The inkjet pen as recited in claim 2, wherein said opening is configured to allow external air to enter into said standpipe only when, once said pen is operational, a back pressure within said standpipe is equal to or greater than a back pressure at which ink will no longer flow to said printhead without external air entering said standpipe through said opening.

4. The inkjet pen as recited in claim 1, wherein said standpipe bubbler further includes a breach mechanism configured to not allow external air to enter into said through said standpipe bubbler until said breach mechanism has been breached.

5. The inkjet pen as recited in claim 4, wherein said breach mechanism hermitically seals said standpipe bubbler until breached.

6. The inkjet pen as recited in claim 4, wherein said breach mechanism is permanently breached once breached.

7. The inkjet pen as recited in claim 4, wherein said breach mechanism is capable of being selectively breached.

8. The inkjet pen as recited in claim 1, wherein said standpipe bubbler comprises an opening through said orifice plate to said standpipe.

9. The inkjet pen as recited in claim 8, wherein said opening is configured to allow external air to enter into said standpipe only when, once said pen is operational, a back pressure within said standpipe is equal to or greater than a back pressure at which ink will no longer flow to said printhead without external air entering said standpipe through said opening.

10. An inkjet pen comprising:

an ink reservoir;

a printhead having an orifice plate with nozzles therein through which ink may be ejected from the printhead;

a standpipe through which ink may flow from said ink reservoir to said printhead;

a filter between said ink reservoir and said standpipe such that ink entering said standpipe from said ink reservoir passes through said filter; and an opening distinct from said nozzles for selectively introducing external air into said standpipe.

11. The inkjet pen as recited in claim 10, wherein said opening fluidically couples said standpipe to a source of air external to said pen but does not fluidically couple said ink reservoir to said source except through said filter.

12. The inkjet pen as recited in claim 10, wherein said opening comprises an opening through said orifice plate to said standpipe.

13. The inkjet pen as recited in claim 10, wherein said opening comprises an opening through a wall at least partially defining said standpipe.

14. The inkjet pen as recited in claim 10, wherein said opening is configured to allow external air to enter into said standpipe only when, once said pen is operational, a back pressure within said standpipe is equal to or greater than a back pressure at which ink will no longer flow to said printhead without external air entering said standpipe through said opening.

* * * * *

UNITED STATES PATENT AND TRADEMARK OFFICE

CERTIFICATE OF CORRECTION

PATENT NO. : 7,380,926 B2
APPLICATION NO. : 11/111127
DATED : June 3, 2008
INVENTOR(S) : Anthony D. Studer et al.

It is certified that error appears in the above-identified patent and that said Letters Patent is hereby corrected as shown below:

Title Pg, Item (57), under "Abstract", in column 2, line 1, after "use" insert -- in --.

In column 6, line 3, in Claim 4, after "said" insert -- standpipe --.

Signed and Sealed this

Ninth Day of September, 2008

JON W. DUDAS
*Director of the United States Patent and Trademark Office*